US007247058B2

(12) United States Patent
Reeser et al.

(10) Patent No.: US 7,247,058 B2
(45) Date of Patent: Jul. 24, 2007

(54) VERTICAL DOCKING CONNECTOR

(75) Inventors: Nancy Lee Reeser, Lemoyne, PA (US); William Crusey Van Scyoc, Shippensburg, PA (US); Michael Warren Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/211,196

(22) Filed: Aug. 25, 2005

(65) Prior Publication Data

US 2007/0049118 A1 Mar. 1, 2007

(51) Int. Cl.
*H01R 13/502* (2006.01)

(52) U.S. Cl. ..... 439/701

(58) Field of Classification Search ..... 439/701, 439/660, 608, 108
See application file for complete search history.

(56) References Cited

U.S. PATENT DOCUMENTS 4,984,992 A * 1/1991 Beamenderfer et al. .... 439/108
5,240,422 A * 8/1993 Kobayashi et al. ..... 439/78
5,558,542 A * 9/1996 O'Sullivan et al. ..... 439/682
5,895,296 A * 4/1999 Okabe ..... 439/701
6,350,134 B1 2/2002 Fogg et al.
6,371,790 B1 * 4/2002 Huang ..... 439/378
6,540,559 B1 4/2003 Kemmick et al.
6,863,549 B2 * 3/2005 Brunker et al. ..... 439/108
6,875,044 B1 * 4/2005 Lee ..... 439/404

* cited by examiner

*Primary Examiner*—Phuong Dinh

(57) ABSTRACT

An electrical connector includes a main housing having a forward mating face and a rearward mounting face, and a plurality of contact modules received in the main housing. Each contact module includes an upper contact module and a lower contact module joined to the upper contact module along side edges of the upper and lower contact modules. Each upper and lower contact module includes a contact housing holding rows of contacts including pairs of signal contacts and individual ground contacts.

19 Claims, 7 Drawing Sheets

VERTICAL DOCKING CONNECTOR

BACKGROUND OF THE INVENTION

The invention relates generally to high speed electrical connectors, and more particularly to a high speed vertical docking connector.

Electrical connectors are commonly used to interconnect electrical circuits or components to one another. Many electronic systems, such as computers, include docking connectors to interconnect various system components. For instance, a docking connector may be used to connect a computer monitor to a hard drive of the computer. Typically, a docking connector includes a plug assembly and a header assembly. The plug assembly may be located, for example, on the hard drive of the computer, while the header assembly may extend from the monitor, such as, via wiring. The plug assembly and the header assembly are mated in order to provide an electrical connection between components of a system, such as the monitor and the hard drive.

Each plug assembly and header assembly includes a plurality of signal contacts and ground contacts. Typically, the signal contacts are arranged in rows or columns and the ground contacts are arranged in rows or columns. Rows of signal contacts are separated from one another by a row of ground contacts. Columns of signal contacts are separated from one another by a column of ground contacts. Thus, the contacts are generally arranged so that, whether in a row or column configuration, each signal contact is adjacent to a ground contact, which is adjacent to another signal contact.

Often, electrical interference and cross talk occur between the signal contacts within the plug and header assemblies. Because the signal columns or rows are in-line with each other, two adjacent signal contacts may electrically interfere and produce cross-talk with each other. The electrical interference and cross-talk among signal contacts reduces the speed and operating efficiency of the system.

Further, typical docking connectors include electrical elements, such as signal contacts, signal pins, ground contacts and ground pins, which are individually mounted within the plug and header assemblies. That is, each assembly typically includes one large bank of electrical elements. Thus, if one electrical element falters, a bank of new electrical elements typically replaces the bank of old electrical elements that included the faltering electrical element. In addition, the docking connectors are typically mounted on circuit boards by soldering each signal and ground pin in the connector to apertures in the circuit board.

Thus a need exists for a docking connector that minimizes electrical interference and cross-talk among signal contacts. A further need exists for a docking connector that may accommodate increased signal speeds.

BRIEF DESCRIPTION OF THE INVENTION

In one aspect, an electrical connector is provided. The connector includes a main housing having a forward mating face and a rearward mounting face, and a plurality of contact modules received in the main housing. Each contact module includes an upper contact module and a lower contact module joined to the upper contact module along side edges of the upper and lower contact modules. Each upper and lower contact module includes a contact housing holding rows of contacts including pairs of signal contacts and individual ground contacts.

Optionally, the mating face and the mounting face are substantially parallel to one another, and the contact mounting ends are configured for press fit insertion into a circuit board. Each of the upper and lower contact modules includes a pair of contact rows. Each of the lower contact modules includes an upper surface and a slot and a rail proximate the upper surface, and each of the upper modules includes a lower surface and a slot and a rail proximate the lower surface. Each slot on the upper and lower contact modules is configured to receive the rail on the other of the upper and lower contact modules to slidably join the upper and lower modules to one another.

In another aspect, a vertical docking connector is provided that includes a main housing having a forward mating face and a rearward mounting face that is substantially parallel to the mating face. A plurality of contact modules are received in the main housing. Each contact module includes an upper contact module and a lower contact module joined to the upper contact module. Each upper and lower contact module includes a contact housing holding rows of contacts including pairs of signal contacts and individual ground contacts. A plurality of contact cavities are formed in the main housing and arranged in transverse rows extending between end sections of the main housing. Each of the plurality of contact cavities receives one of an individual ground contact and a pair of signal contacts.

In a further aspect, a vertical docking connector is provided that includes a main housing having a forward mating face and a rearward mounting face that is substantially parallel to the mating face. A plurality of contact modules are received in the main housing. Each contact module includes an upper contact module and a lower contact module joined to the upper contact module along side edges of the upper and lower contact modules. Each upper and lower contact module includes a contact housing holding rows of contacts including pairs of signal contacts and individual ground contacts. A plurality of contact cavities are formed in the main housing and arranged in transverse rows extending between end sections of the main housing. Each of the plurality of contact cavities receives one of an individual ground contact and a pair of signal contacts.

DETAILED DESCRIPTION OF THE INVENTION

Figure 1:
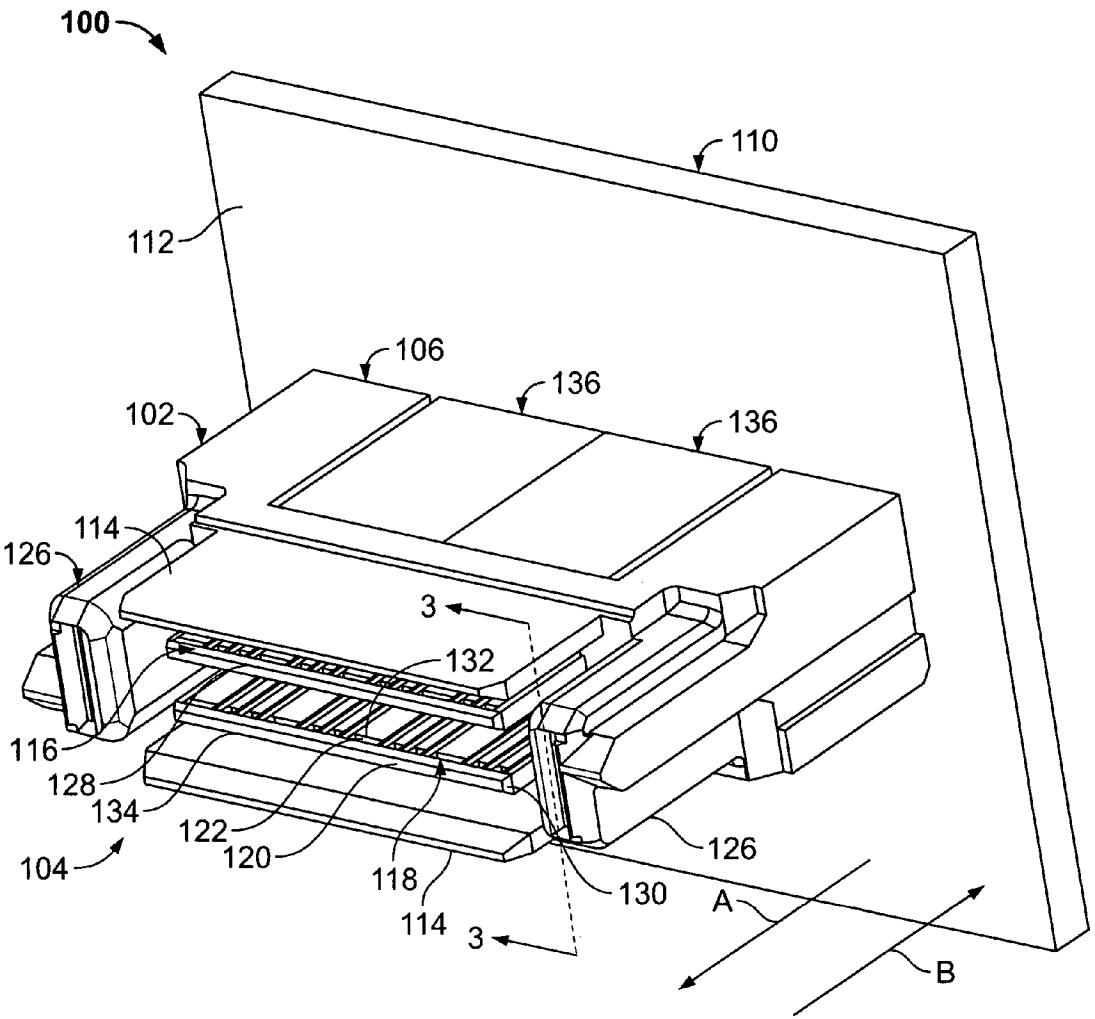
FIG. 1 is a perspective view of a docking connector formed in accordance with an exemplary embodiment of the present invention.

FIG. 1 illustrates an electrical connector 100 formed according to an exemplary embodiment of the present invention. The connector 100 includes a main housing 102 that has a mating face 104 and a mounting face 106. The connector 100 is mounted on a circuit board 110. The mating face 104 is substantially parallel to the mounting face 106 such that the connector extends from the mounting face 106 to the mating face 104 in a direction substantially perpendicular to a surface 112 of the circuit board 110 as indicated by the arrow A. Although the orientation of the circuit board 110 can vary, the connector 100 is sometimes referred to as a vertical connector due to its orientation with respect to the circuit board 110. A mating connector (not shown) is moved in the direction of the arrow B, perpendicularly toward the circuit board 110 when being mated with the connector 100.

In an exemplary embodiment, the connector 100 is a docking connector that may be used to connect an electronic device (not shown) to the circuit board 110 or to interconnect the circuit board 110 to a back plane board (not shown) in a motherboard to daughter card relationship wherein the motherboard and daughter card can be perpendicular to each other. It is to be understood, however, that the foregoing applications are set fourth by way of example only, and that other applications of the inventive concepts herein are also contemplated.

The connector 100 further includes upper and lower shrouds 114 that extend forwardly from the main housing 102. Contact groups 116 and 118 are provided that each includes signal contact pairs 120 and individual ground contacts 122, arranged in patterns as will be described. The contact groups 116 and 118 extend transversely between opposed ends sections 126 of the main housing 102. The contact groups 116 and 118 are arranged with pairs of contact rows wherein each pair of contact rows include an upper contact row and a lower contact row that are separated from one another by an upper tab 128 and a lower tab 130 of dielectric material that extend forwardly from the main housing 102. (Note that only the upper contact rows are visible in FIG. 1, and the upper and lower contact rows are described in detail with reference to FIGS. 4 and 5.) Each of the upper and lower tabs 128 and 130, respectively, has an upper surface 132 and a lower surface 134. The contacts 120 and 122 in the upper contact rows are in registry with a respective upper surface 132 while the contacts 120 and 122 in the lower contact rows are in registry with a respective lower surface 134 of the tabs 128 and 130.

The signal contact pairs 120 and individual ground contacts 122 are held in contact modules 136 that are loaded into the main housing 102. Although the connector 100 will be described in terms of two contact modules 136, it is to be understood that the connector 100 is expandable and in other embodiments, the connector 100 may include fewer than or greater than two contact modules 136. Also, the contact modules may be reduced or expanded in size to include fewer or more contacts in comparison to the contact modules 136. Further, in some applications, the connector 100 may be configured to include only one of the contact groups 116 or 118.

Figure 2:
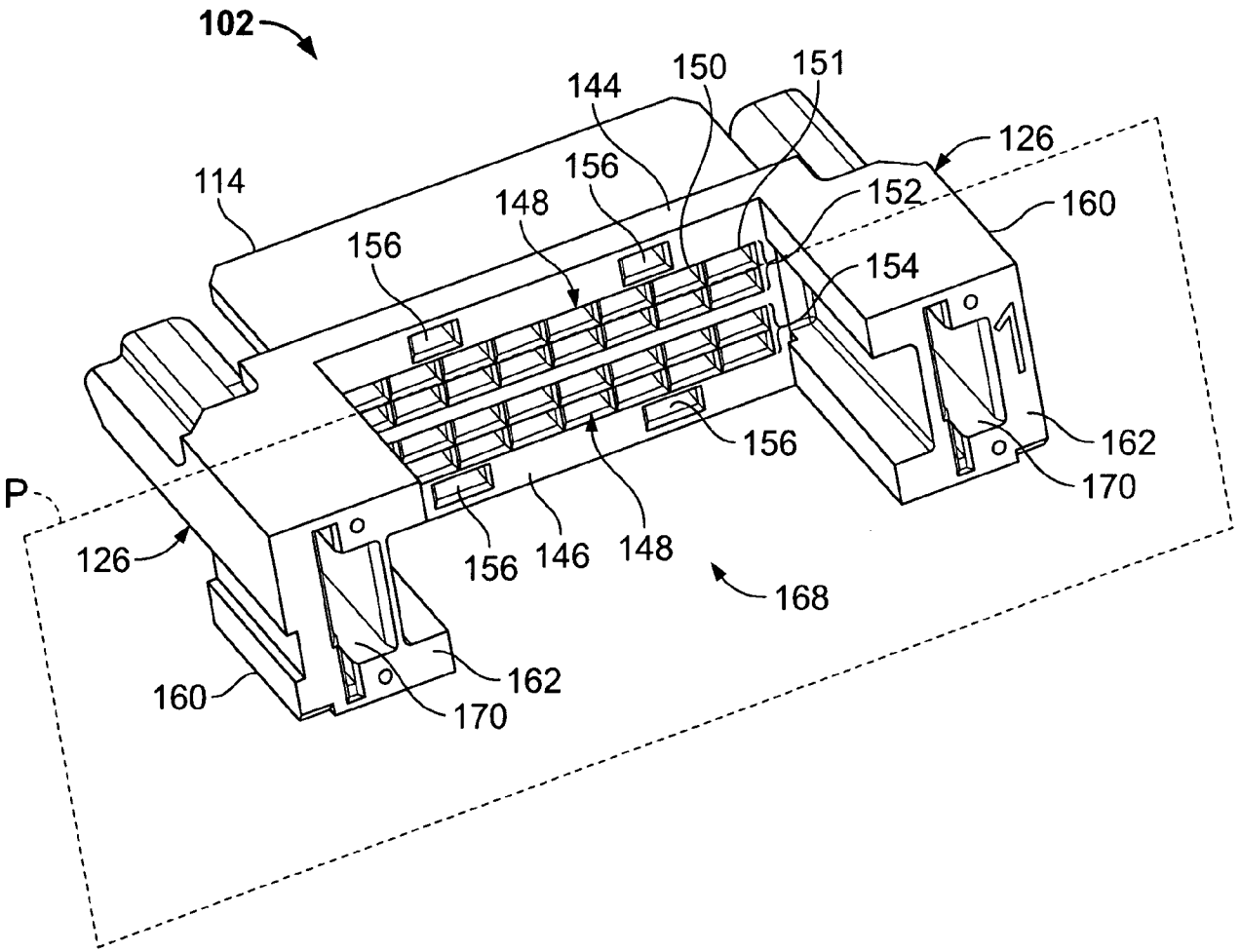
FIG. 2 is a rear perspective view of the main housing of the docking connector shown in FIG. 1.

FIG. 2 is a rear perspective view of the main housing 102 of the docking connector 100. In FIG. 2, the contact modules 136 (FIG. 3) are removed. The main housing 102 includes a body portion 144 that extends between end sections 126. The shrouds 114 are attached to the body portion 144. The body portion 144 has a rear face 146. The body portion 144 includes a plurality of contact cavities 148 that extend through the body portion 144. The contact cavities 148 are arranged in pairs of transverse rows 152 and 154 extending between the end sections 126 of the main housing 102. The transverse contact cavity rows 152 and 154 correspond to the contact rows in the contact groups 116 and 118. The contact cavities 148 include signal contact cavities 150 that receive pairs of signal contacts 120 and ground contact cavities 151 that receive individual ground contacts 122. A plurality of alignment holes or receptacles 156 are formed in the rear face 146 of the body portion 144. Although the alignment holes 156 are shown in FIG. 2 as having a substantially rectangular shape, it is to be understood that any geometric shape may be employed in alternative embodiments.

Each of the end sections 126 includes a rearward extension 160 that includes a rear face 162. The rear faces 162 define a plane P that includes the connector mounting face 106 (FIG. 1). The rearward extensions 160 and the rear face 146 of the body portion 144 define a contact module loading area 168 in which the contact modules 136 (FIG. 1) are received. In an exemplary embodiment, the end sections 126 each include a power contact cavity 170 that receives a power contact 172 (FIG. 3).

Figure 3:
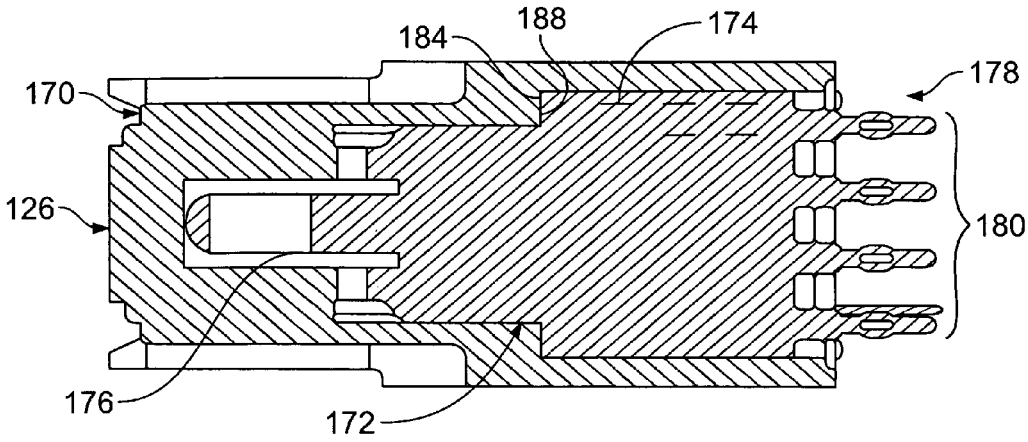
FIG. 3 is a cross sectional view taken through the power contact cavity along the line 3-3 in FIG. 1.

FIG. 3 is a cross section taken through the power contact cavity 170 along the line 3-3 in FIG. 1. The power contact 172 includes a body portion 174, a mating end 176 and a mounting end 178 having a plurality of pins 180 extending therefrom. The pins 180 are compliant pins configured for press fit installation in the circuit board 110 (FIG. 1). The end section 126 of the main housing 102 includes a push shoulder 184 formed on an interior wall that engages a complementary shoulder 188 formed on the power contact 172. The push shoulder 184 is provided to transmit insertion forces from the main housing 102 to the power contact 172 and to the circuit board 110 during installation of the connector 100 on the circuit board 110.

Figure 4:
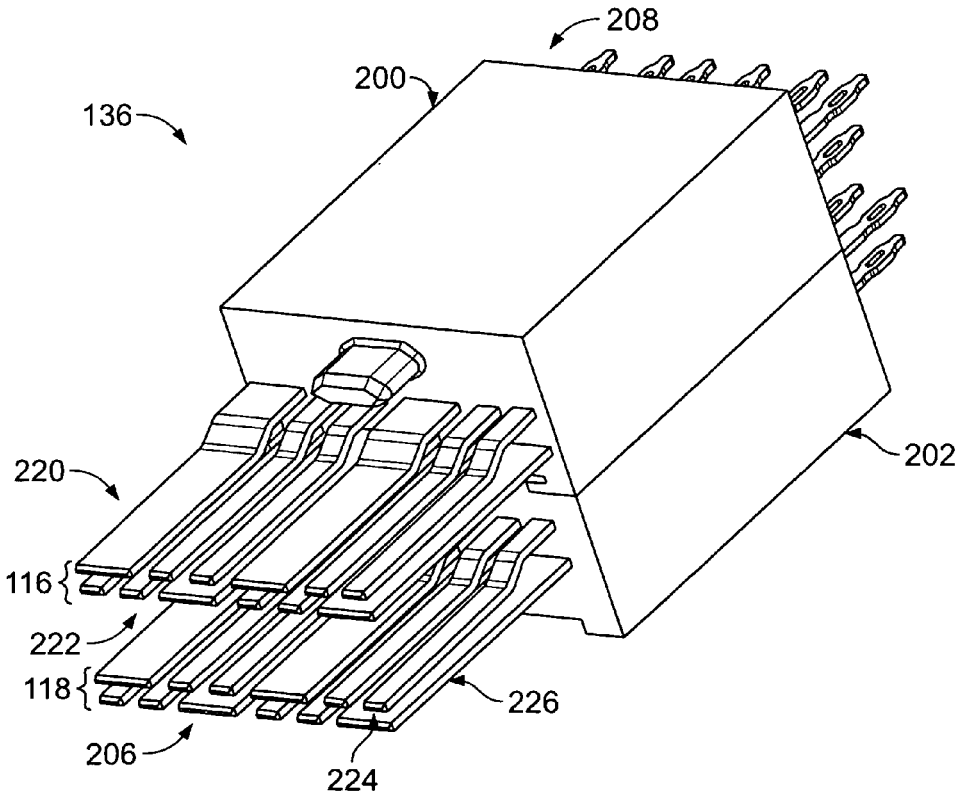
FIG. 4 is a perspective view of a contact module formed in accordance with an exemplary embodiment of the present invention.

FIG. 4 illustrates a perspective view of the contact module 136. The contact module 136 includes an upper contact module 200 and a lower contact module 202. The contact module 136 has a mating end 206 and a mounting end 208. The mating end 206 and mounting end 208 are common to the upper contact module 200 and the lower contact module 202. When the contact module 136 is loaded into the main housing 102 (FIG. 1), the mounting end 208 is coextensive with and forms a part of the mounting face 106 of the main housing 102. Upper contact module 200 and lower contact module 202 each include rows 116 and 118 of contacts 120 and 122. More specifically, the upper contact module 200 includes a first contact row 220 and a second contact row 222 and the lower contact module 202 includes a third contact row 224 and a fourth contact row 226. When the contact module 136 is loaded into the main housing 102, the first and second contact rows 220 and 222, respectively are separated by the upper tab 128 (FIG. 1) and the third and fourth contact rows 224 and 226, respectively, are separated by the lower tab 130 (FIG. 1). In an application where the connector 100 (FIG. 1) is configured to include only one contact row 116 or 118, a corresponding upper or lower contact module 200 or 202 is omitted.

Figure 5:
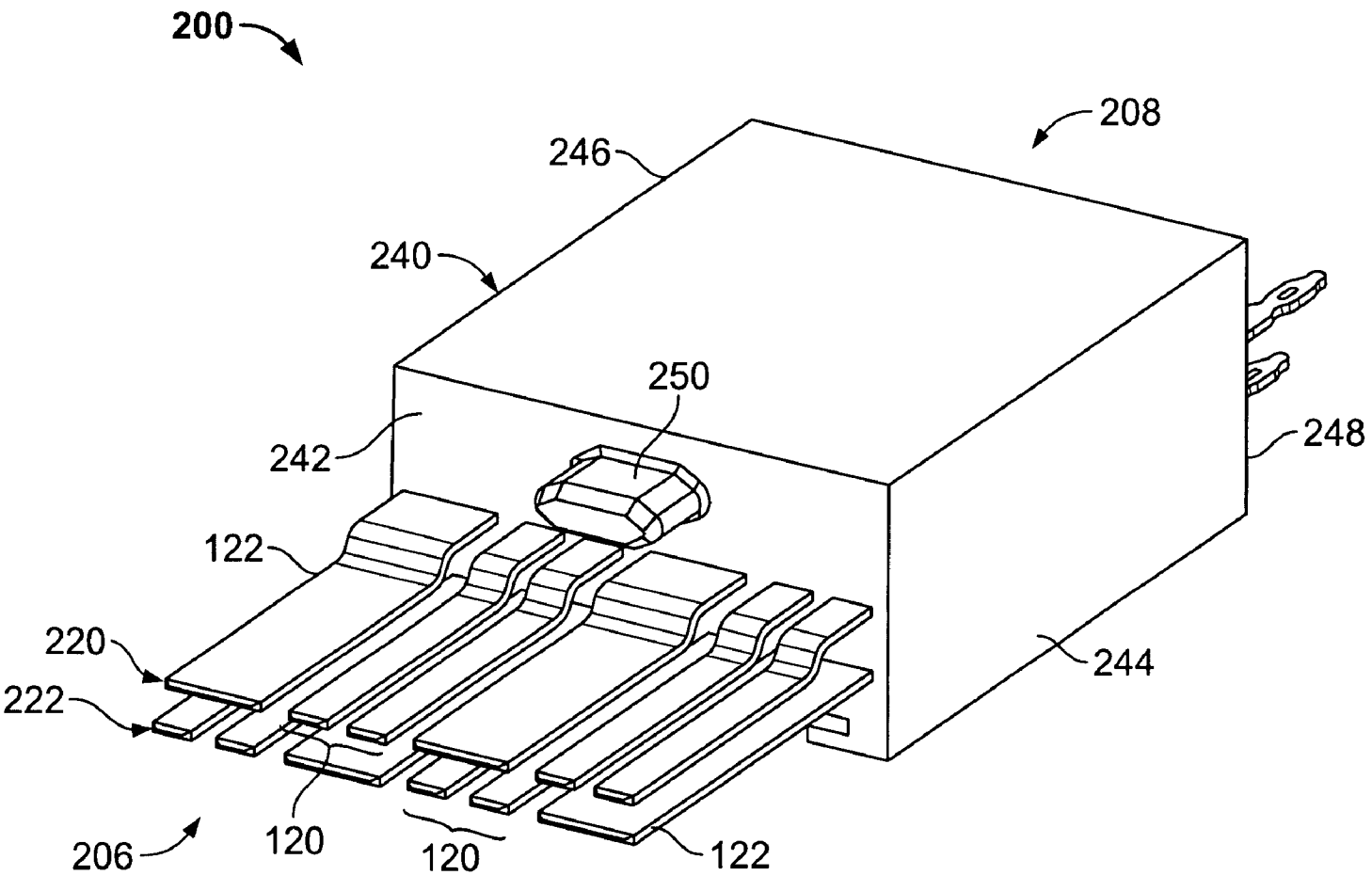
FIG. 5 is a perspective view of the upper contact module shown in FIG. 4.

FIG. 5 is a perspective view of the upper contact module 200 shown in FIG. 4. The upper module 200 includes a contact housing 240 that has a front face 242 opposite the mounting end 208 and substantially parallel opposite sides 244 and 246 extending between the front face 242 and a rear face 248 at the mounting end 208. An alignment post 250 is formed above the contact rows 220 and 222 and extends forwardly from the front face 242. The alignment post 250 is complementary in shape to the alignment holes 156 (FIG. 2) formed in the rear face 146 (FIG. 2) of the body portion 144 of the main housing 102 (FIG. 2). The front face 242 engages the rear face 146 of the body portion 144 of the main housing 102 when the contact module 136 (FIG. 4) is loaded into the main housing 102. Further, when the contact module 136 is loaded into the main housing 102, the alignment post 250 is received in one of the alignment holes 156 and each individual ground contact 122 is received in a respective ground contact cavity 151 (FIG. 2) while each signal contact pair 120 is received in a respective signal contact cavity 150 (FIG. 2) both of which are formed in the rear face 146 of the body portion 144 of the main housing 102.

The signal contact pairs 120 and the individual ground contacts 122 in the contact rows 220 and 222 are arranged in a pattern wherein the signal contact pairs 120 in each row 220, 222 are separated from one another by an individual ground contact 122. Further, the signal contact pairs 120 and the individual ground contacts 122 in the contact rows 220 and 222 are staggered or shifted with respect to one another such that no signal contact pair 120 is positioned directly above or below another signal contact pair 120, and likewise, no individual ground contact 122 is positioned directly above or below another individual ground contact 122. Thus, the signal contact pair 120 and individual ground contacts 122 are arranged such that no signal contact pair 120 is horizontally or vertically directly adjacent to another signal contact pair 120. That is, two signal contact pairs 120 positioned within the same row are separated by an individual ground contact 122. The arrangement of the signal contact pairs 120 and the individual ground contacts 122 reduces cross talk between signal contact pairs 120 enabling the connector 100 to be used as a high speed docking connector.

In an exemplary embodiment, the signal contact pairs 120 and the individual ground contacts 122 are laid out as described and then overmolded with the contact housing 240. Overmolding the contact housing 240 secures the signal contact pairs 120 and the ground contacts 122 in position and facilitates maintaining a consistent contact spacing between the signal contact pairs 120 and the ground contacts 122, and also between the individual signal contacts 350 (FIGS. 8 and 9) of the signal contact pairs 120.

Figure 6:
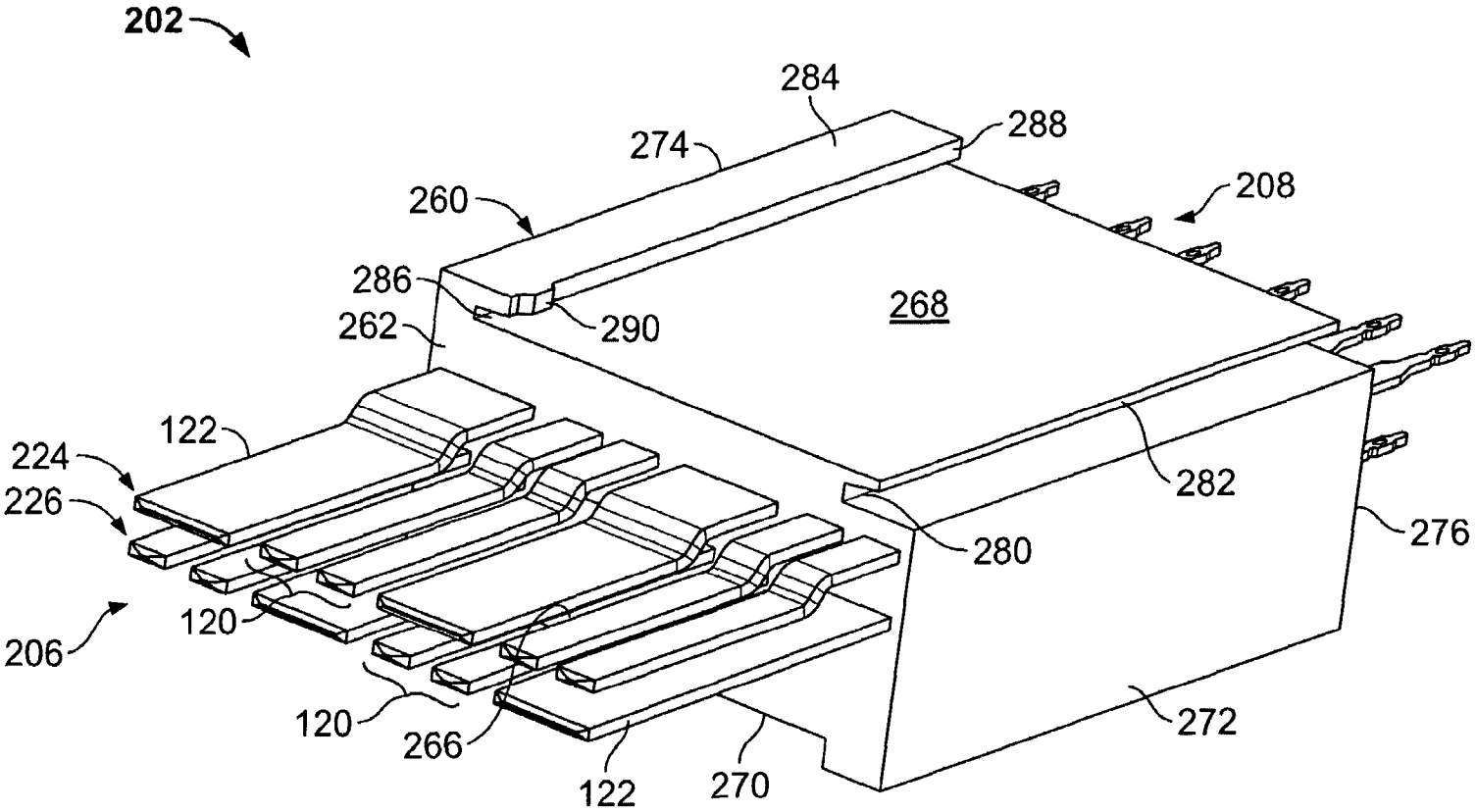
FIG. 6 is a perspective view of the lower contact module shown in FIG. 4.

FIG. 6 is a perspective view of the lower contact module 202 shown in FIG. 4. The lower contact module 202 includes a contact housing 260 that has a front face 262 opposite the mounting end 208. An alignment post 266, which is almost hidden from view in FIG. 6, is formed beneath the contact rows 224 and 226 and extends forwardly from the front face 262. The alignment post 266 is complementary in shape to the alignment holes 156 (FIG. 2) formed in the rear face 146 (FIG. 2) of the body portion 144 of the main housing 102 (FIG. 2). The front face 262 engages the rear face 146 of the body portion 144 of the main housing 102 when the contact module 136 (FIG. 4) is loaded into the main housing 102. Further, when the contact module 136 is loaded into the main housing 102, the alignment post 266 is received in one of the alignment holes 156 and each individual ground contact 122 is received in a respective ground contact cavity 151 (FIG. 2) while each signal contact pair 120 is received in a respective signal contact cavity 150 (FIG. 2) both of which are formed in the rear face 146 of the body portion 144 of the main housing 102.

The signal contact pairs 120 and the individual ground contacts 122 in the contact rows 224 and 226 are arranged in a pattern that is identical to the contact pattern described above with respect to the upper contact module 200 and need not be repeated. As with the upper contact module 200, the arrangement of the signal contact pairs 120 and the individual ground 122 contacts reduces cross talk between signal contact pairs 120 in the lower contact module 202 which enables the connector 100 to be used as a high speed docking connector. Further, as described with respect to the upper contact module 200, in an exemplary embodiment, the signal contact pairs 120 and the individual ground contacts 122 are overmolded with the contact housing 260. Overmolding the contact housing 260 secures the signal contact pairs 120 and the ground contacts 122 in position and facilitates maintaining a consistent contact spacing between the signal contact pairs 120 and the ground contacts 122, and also between the individual signal contacts 350 (FIGS. 8 and 9) of the signal contact pairs 120.

The contact housing 260 includes an upper surface 268, a lower surface 270, and substantially parallel first and second opposite sides 272 and 274 extending between the front face 262 and a mounting face 276 at the mounting end 208 of the contact module 202. A first slot 280 is formed in the first side 272 proximate the upper surface 268. The upper surface 268 defines a lip 282 that also forms an upper side of the first slot 280. A rail 284 is formed at an upper edge of the second side 274. The rail 284 defines a second slot 286 between the rail 284 and the upper surface 268. The rail 284 includes an edge 288 that has a positioning key 290 extending therefrom proximate the front face 262 of the contact housing 260.

Figure 7:
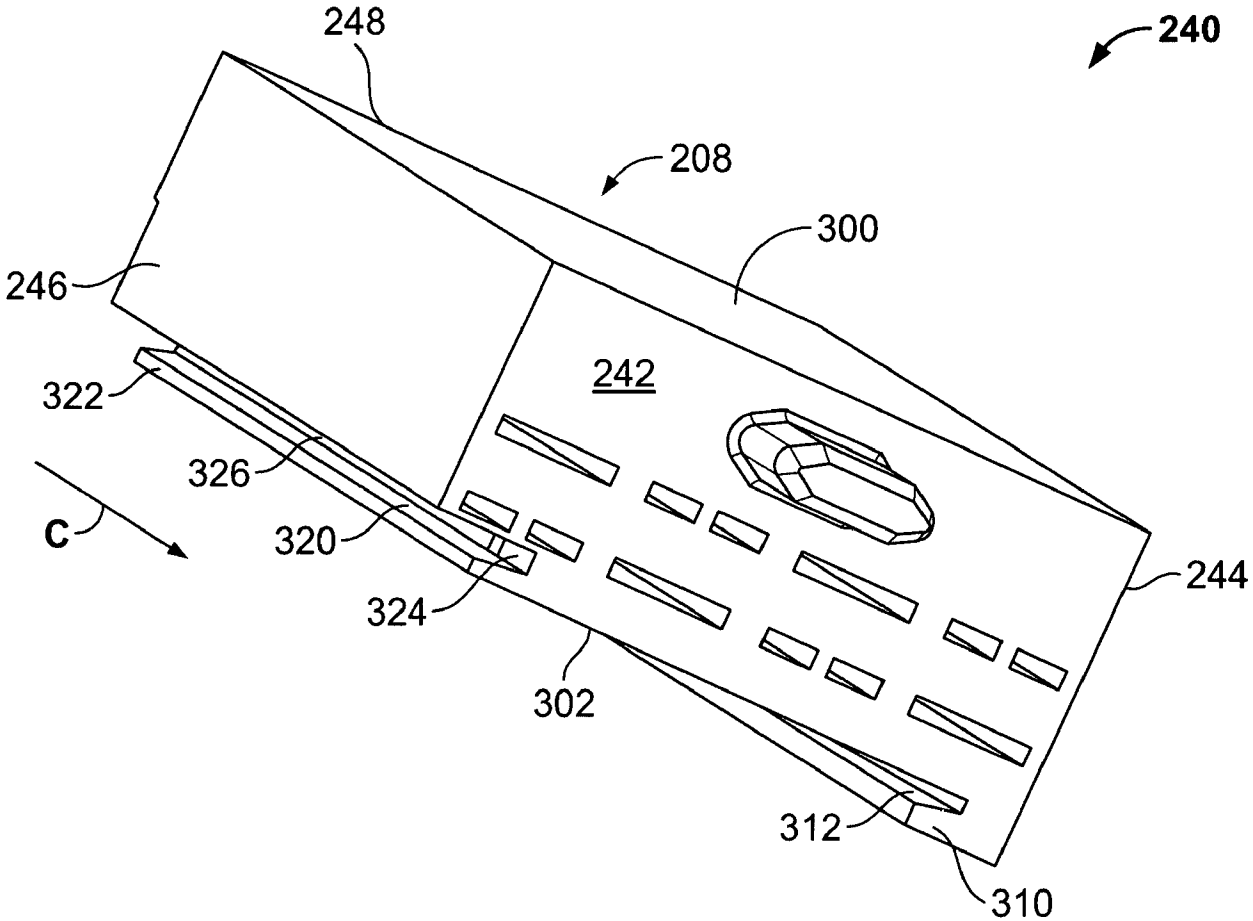
FIG. 7 is a bottom perspective view of the contact housing of the upper contact module shown in FIG. 5.

FIG. 7 is a bottom perspective view of the contact housing 240 of the upper contact module 200 shown in FIG. 5. In FIG. 7, the housing is shown without contacts to expose certain features of the contact housing 240. It should be kept in mind that since the contact housing 240 is overmolded onto the contact rows 220 and 222, the contact housing does not, in reality, exist without the contact rows 220 and 222. Similar to the lower contact housing 260 previously described, the contact housing 240 includes an upper surface 300 and a lower surface 302 between the first side 244 and the second side 246. A rail 310 is formed at a lower edge of the first side 244. The rail 310 defines a first slot 312 between the rail 310 and the lower surface 302. A second slot 320 is formed in the second side 246 proximate the lower surface 302. The lower surface 302 defines a lip 322 that also forms a lower side of the second slot 320. A keying receptacle 324 is formed in a bottom 326 of the second slot 320.

With reference to FIGS. 5, 6 and 7, the contact module 136 (FIG. 4) is formed by joining the upper and lower contact module 200 (FIG. 5) and 202 (FIG. 6), respectively, to one another along their respective side edges. The upper contact module 200 is joined to the lower contact module 202 by bringing the lower surface 302 (FIG. 7) of the upper contact housing 240 into engagement with the upper surface 268 (FIG. 6) of the lower contact housing 260 and sliding the upper contact housing 240 in the direction of the arrow C. As the upper and lower housings 240 and 260, respectively, are slid together, the rail 310 of the upper contact housing 240 is received in the first slot 280 of the lower contact housing 260 and the lip 282 on the lower contact housing is received in the first slot 312 of the upper contact housing. Simultaneously, the lip 322 on the upper contact housing is received in the second slot 286 of the lower contact housing 260 while the rail 284 on the lower contact housing 260 is received in the second slot 320 of the upper contact housing 240. The positioning key 290 on the rail 284 of the lower contact housing 260 is received in the keying receptacle 324 formed in the second slot 320 of the upper contact housing 240 to align the upper and lower contact modules 200 and 202 with respect to one another and thus forming the contact module 136.

Figure 8:
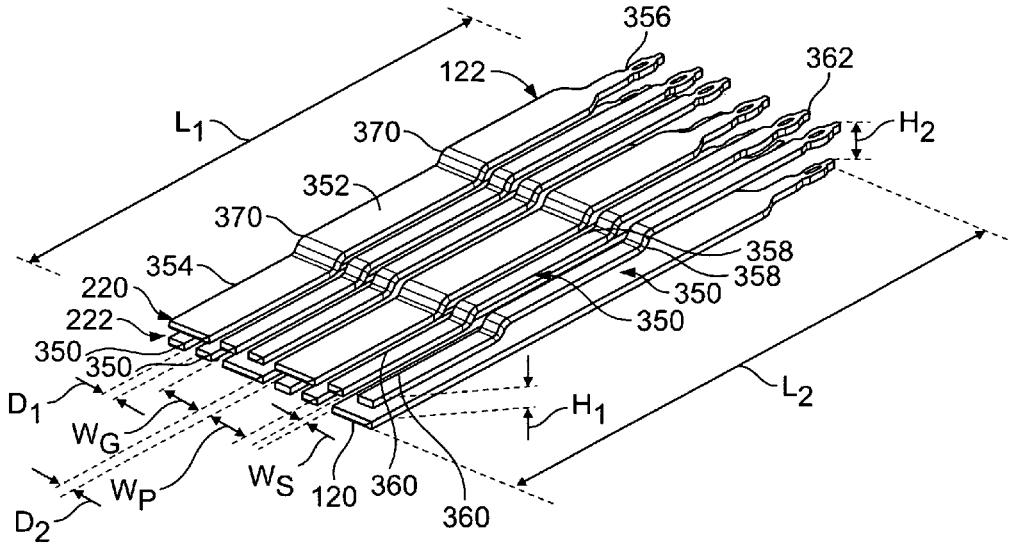
FIG. 8 is a perspective view of the contacts of the upper contact module which are formed in accordance with an exemplary embodiment of the present invention.
Figure 9:
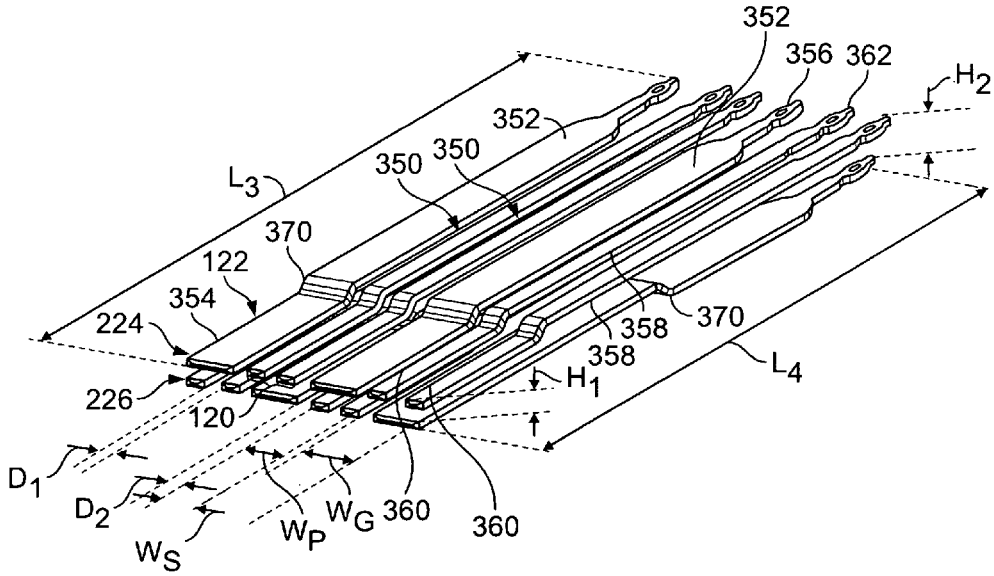
FIG. 9 is a perspective view of the contacts of the lower contact module which are formed in accordance with an alternative exemplary embodiment of the present invention.

FIG. 8 is a perspective view of the contact rows 220 and 222 of the upper contact module 200 which are formed in accordance with an exemplary embodiment of the present invention. FIG. 9 is a perspective view of the contact rows 224 and 226 of the lower contact module 202 which are formed in accordance with an alternative exemplary embodiment of the present invention. Each of the contact rows 220, 222, 224, and 226 contains individual ground contacts 122 and signal contact pairs 120. Each of the signal contact pairs 120 is comprised of two individual signal contacts 350. The individual ground contacts 122 have planar blade-shaped body portions and blade portions 352 and 354, respectively. The individual ground contacts have a compliant eye of the needle type pin contact 356 that is configured for press-fit installation in a circuit board such as the circuit board 110. Similarly, the individual signal contacts 350 have planar, blade-shaped body portions and blade portions 358 and 360, respectively. The individual signal contacts 350 have compliant eye of the needle type pin contacts 362 that are configured for press-fit installation in a circuit board such as the circuit board 110.

The ground and signal pin contacts 356 and 362, respectively, exhibit the same pattern as previously described with respect to the signal contact pairs 120 and the individual ground contacts 122. That is, the pin contacts 356 and 362 are arranged such that pairs of signal pin contacts 362 are separated from one another by a ground contact pin 356. Further, no pair of signal pin contacts 362 is positioned directly above or below another pair of signal pin contacts 362.

Similarly, no individual ground pin contact 356 is positioned directly above or below another individual ground pin contact 356. Thus, pairs of signal pin contacts 362 and individual ground pin contacts 356 are arranged such that no pair of signal pin contacts 362 is horizontally or vertically directly adjacent to another pair of signal pin contacts 362. Pairs of signal pin contacts 356 positioned within the same row are separated by an individual ground pin contact 356. The arrangement of the signal pin contacts 362 and the individual ground pin contacts 356 maintains favorable cross talk reduction properties throughout the connector 100.

The contacts in each of the contact rows 220, 222, 224, and 226 have overall contact lengths $L_1$, $L_2$, $L_3$, and $L_4$, respectively, which are all substantially equal to one another. The mating ends 354 and 360 of the contacts in contact rows 220 and 222 are separated by a vertical distance $H_1$ while the mounting pins 356 and 362 are separated by a vertical distance $H_2$ that is different from the distance $H_1$. In an exemplary embodiment, the distance $H_2$ is greater than the distance $H_1$. Thus there is a transition in the vertical separation of the contacts in the contact rows 220 and 222 from the mounting pins 356 and 362 to the mating ends 354 and 360. In FIG. 8, each of the contacts in the first contact row 220 is formed with two steps 370 while the contacts in the second contact row 222 are substantially flat. The steps 370 are sized to reduce the vertical separation of the contacts from the distance $H_2$ at the pins 356 and 362 to $H_1$ at the mating ends 354 and 360 of the contacts 122 and 350. The contacts in the contact rows 224 and 226, shown in FIG. 9, are formed such that the vertical separation $H_1$ at the contact mating ends 354, 360 is substantially the same as the vertical separation $H_1$ at the contact mating ends 354, 360 in the contact rows 220 and 222. Similarly, the vertical separation $H_2$ of the mounting pins 356 and 362 in the contact rows 224 and 226 is substantially the same as the vertical separation $H_2$ of the mounting pins 356 and 362 in the contact rows 220 and 222.

In the embodiment shown in FIG. 9, which represents the contact configuration of the lower contact module 202, the contacts in each contact row 224 and 226 each include one step 370 sized to reduce the vertical separation of the contacts from the distance $H_2$ at the pins 356 and 362 to $H_1$ at the mating ends 354 and 360 of the contacts 122 and 350. For each of the contact row pairs 220, 222 and 224, 226, the vertical spacing $H_1$ is approximately equal to a thickness of the tabs 128 and 130 (FIG. 1) on the main housing 102 (FIG. 1) that separate the contact rows 220, 222 and 224, 226. In general it may be stated that the contacts in at least one row of the contact row pairs 220, 222 and 224, 226 include at least one step to accomplish the transition from $H_2$ at the pins 356 and 362 to $H_1$ at the mating ends 354 and 360.

Each individual ground contact 122 has a width $W_G$, while each signal contact pair 120 has a width $W_P$ that is approximately the same as the width $W_G$. In an exemplary embodiment, the signal contact cavities 150 (FIG. 2) include additional housing material within to keep the contacts of the signal contact pair 120 separated from one another and the width $W_P$ of the signal contact pair 120 may be slightly greater than the width $W_G$ of the individual ground contacts 122. Each individual signal contact 350 has a width $W_S$ and is separated from the other individual signal contact 350 in the signal contact pair 120 by a distance $D_1$. The individual ground contacts 122 are separated from an adjacent individual signal contact 350 by a distance $D_2$ which is approximately the same as the distance $D_1$. Thus, the sum of the widths $W_S$ of each of the individual signal contacts 350 along with the distance $D_1$ separating the individual signal contacts 350 is approximately the same as the width $W_G$ of an individual ground contact 122.

In alternative embodiments, the individual ground contacts 122 and individual signal contacts 350 may include windows, notches, or other features that provide fill areas for the overmold plastic material in the contact housings 240, 260 (FIGS. 5 and 6) during the overmold process. Such areas provide reinforcement against the insertion forces associated with press fit installation of the connector 100 (FIG. 1) on a circuit board 110 (FIG. 1) to prevent the individual ground and signal contacts 122 and 350, respectively, from being pushed out of the upper and lower contact modules 200 (FIG. 5) and 202 (FIG. 6), respectively.

As previously described, the signal contact pairs 120 and the individual ground contacts 122 in the contact row pairs 220 and 222, and the contact row pairs 224 and 226 are arranged in a pattern wherein the signal contact pairs 120 in each row 220, 222, 224, and 226 are separated from one another by an individual ground contact 122. Further, the signal contact pairs 120 and the individual ground contacts 122 in the contact row pair 220 and 222 and the contact row pair 224 and 226 are staggered or shifted with respect to one another such that no signal contact pair 120 is positioned directly above or below another signal contact pair 120, and likewise, no individual ground contact 122 is positioned directly above or below another individual ground contact 122. Thus, the signal contact pair 120 and individual ground contacts 122 are arranged such that no signal contact pair 120 is horizontally or vertically directly adjacent to another signal contact pair 120. That is, two signal contact pairs 120 positioned within the same row are separated by an individual ground contact 122. Furthermore, two signal contact pairs 120 positioned within the same column in the two contact rows 220 and 222 as well as the two contact rows 224 and 226 are separated by an individual ground contact 122. The arrangement of the signal contact pairs 120 and the individual ground contacts 122 is such that the individual ground contacts 122 act as shields for the signal contact pairs 120 thereby reducing cross talk between signal contact pairs 120 enabling the connector 100 to be used as a high speed docking connector. The pattern of the individual ground contacts 122 and the signal contact pairs 120 is substantially identical to the pattern, or configuration, of the mounting pins 356 of the individual ground contacts 122 in relation to mounting pins 362 of the signal contact pairs 120. Thus, there is a similar result, wherein cross talk between the pins 362 of the signal contact pairs 120 is reduced facilitating high speed signal transmission through the connector 100.

The embodiments thus described provide a high speed vertical docking connector 100 that can deliver both high speed signal and power. The connector utilizes contact modules 136 that can be varied in size and number for a given application. The connector is vertically oriented on a circuit board 110 so that a mating component may be perpendicularly oriented with respect to the circuit board. The contacts 122, 350 include compliant mounting pins 356 and 362 for a press fit installation in a circuit board. The main housing 102 includes push shoulders 184 formed internally in the power contact cavities 170 to transmit insertion forces associated with press fit installation. The contact modules include upper modules and lower modules 200, 202 that are provided with rails that are received in corresponding slots for joining the modules together. Alignment posts are provided on the upper and lower modules that are received in receptacles on the main housing to align the contact modules in the main housing. The upper and lower contact modules include an overmolded contact housing to preserve the positioning and spacing of the contacts.

While the invention has been described in terms of various specific embodiments, those skilled in the art will recognize that the invention can be practiced with modification within the spirit and scope of the claims.

What is claimed is:

1. An electrical connector comprising:

a main housing having a forward mating face and a rearward mounting face; and a plurality of contact modules received in said main housing, each said contact module including an upper contact module and a lower contact module, said upper and lower contact modules having abutting surfaces, each said upper and lower contact module including a contact housing holding rows of contacts;

wherein each of said lower contact modules includes an upper surface and a slot and a rail proximate said upper surface, and each of said upper contact modules includes a lower surface and a slot and a rail proximate said lower surface, and wherein each said slot on said upper and lower contact modules is configured to receive the rail on the other of said upper and lower contact modules to slidably join said upper and lower contact modules to each other.

2. The connector of claim 1, wherein said connector further includes a power contact held in said main housing.

3. The connector of claim 1, wherein said mating face and said mounting face are substantially parallel to one another.

4. The connector of claim 1, wherein each of said contacts includes a mating end and a mounting end, said mounting end configured for press fit insertion into a circuit board.

5. The connector of claim 1, wherein each of said upper and lower contact modules includes a pair of vertically spaced contact rows, said contacts in said pair of contact rows having a first spacing between rows at a mating end and a second spacing between rows at a mounting end, said second spacing being different from said first spacing, and wherein said contacts in at least one of said rows includes at least one step to transition said contacts from said first spacing to said second spacing.

6. The connector of claim 1, wherein said rail of one of said upper and lower contact modules includes a positioning key and said slot on the other of said upper and lower contact modules includes a keying receptacle complementary to said positioning key and receiving said positioning key when said upper and lower contact modules are joined together.

7. The connector of claim 1, wherein each of said upper and lower contact modules further includes an alignment post and said main housing further includes a plurality of alignment holes, each of said alignment posts being received in one of said alignment holes.

8. The connector of claim 1, wherein said contact housing is overmolded onto said rows of contacts.

9. The connector of claim 1, wherein each of said upper and lower contact modules includes a pair of contact rows and wherein said pair of contact rows are separated from one another by a layer of dielectric material on said main housing when said upper and lower contact modules are loaded into said main housing.

10. A vertical docking connector comprising:

a main housing having a forward mating face and a rearward mounting face that is substantially parallel to said mating face;

a plurality of contact modules received in said main housing, each said contact module including an upper contact module and a lower contact module joined to said upper contact module, each said upper and lower contact module including a contact housing holding rows of contacts including pairs of signal contacts and individual ground contacts; and a plurality of contact cavities formed in said main housing and arranged in transverse rows extending between end sections of said main housing, wherein some of said plurality of contact cavities receive an individual ground contact and others of said cavities receive a pair of signal contacts; and wherein each said end section of said main housing includes a power contact cavity, said power contact cavity including a push shoulder formed on an interior wall and configured to engage a complementary shoulder on a power contact.

11. The vertical docking connector of claim 10, wherein said connector further includes a respective said power contact held in each said power contact cavity.

12. The vertical docking connector of claim 10, wherein each of said contacts includes a mating end and a mounting end, said mounting end configured for press fit insertion into a circuit board.

13. The vertical docking connector of claim 10, wherein each of said upper and lower contact modules includes a pair of vertically spaced contact rows, said contacts in said pair of contact rows having a first spacing between rows at a mating end and a second spacing between rows at a mounting end, said second spacing being different from said first spacing, and wherein said contacts in at least one of said rows includes at least one step to transition said contacts from said first spacing to said second spacing.

14. The vertical docking connector of claim 10, wherein each of said lower contact modules includes an upper surface and a slot and a rail proximate said upper surface, and each of said upper modules includes a lower surface and a slot and a rail proximate said lower surface, and wherein each said slot on said upper and lower contact modules is configured to receive the rail on the other of said upper and lower contact modules to slidably join said upper and lower modules to one another.

15. The vertical docking connector of claim 10, wherein each of said lower contact modules includes an upper surface and a slot and a rail proximate said upper surface, and each of said upper modules includes a lower surface and a slot and a rail proximate said lower surface, and wherein each said slot on said upper and lower contact modules is configured to receive the rail on the other of said upper and lower contact modules, said rail of one of said upper and lower contact modules including a positioning key and said slot on the other of said upper and lower contact modules including a keying receptacle complementary to said positioning key and receiving said positioning key when said upper and lower contact modules are joined together.

16. The vertical docking connector of claim 10, wherein each of said upper and lower contact modules further includes an alignment post and said main housing further includes a plurality of alignment holes, each of said alignment posts being received in one of said alignment holes.

17. The vertical docking connector of claim 10, wherein each of said upper and lower contact modules including a pair of contact rows and wherein said pair of contact rows are separated from one another by a layer of dielectric material on said main housing when said upper and lower contact modules are loaded into said main housing.

18. A vertical docking connector comprising:

a main housing having a forward mating face and a rearward mounting face that is substantially parallel to said mating face;

a plurality of vertically oriented contact modules received in said main housing, each said contact module including an upper contact module and a lower contact module joined to said upper contact module along side edges of said upper and lower contact modules, each said upper and lower contact module including a contact housing holding rows of contacts including pairs of signal contacts and individual ground contacts; and a plurality of contact cavities formed in said main housing and arranged in transverse rows extending between end sections of said main housing, wherein some of said plurality of contact cavities receive an individual ground contact and others of said cavities receive a pair of signal contacts;

wherein each of said lower contact modules includes an upper surface and a slot and a rail proximate said upper surface, and each of said upper modules includes a lower surface and a slot and a rail proximate said lower surface, and wherein each said slot on said upper and lower contact modules is configured to receive the rail on the other of said upper and lower contact modules to slidably join said upper and lower modules to each other.

19. The vertical docking connector of claim 18, wherein said rail of one of said upper and lower contact modules includes a positioning key and said slot on the other of said upper and lower contact modules includes a keying receptacle complementary to said positioning key and receiving said positioning key when said upper and lower contact modules are joined together.

* * * * *